United States Patent [19]

Vollmar

[11] 4,455,957

[45] Jun. 26, 1984

[54] THREAD CUTTER FOR A ZIG-ZAG SEWING MACHINE

[75] Inventor: Kurt Vollmar, Weilerbach, Fed. Rep. of Germany

[73] Assignee: Pfaff Industriemaschinen GmbH, Fed. Rep. of Germany

[21] Appl. No.: 386,305

[22] Filed: Jun. 8, 1982

[30] Foreign Application Priority Data

Jun. 24, 1981 [DE] Fed. Rep. of Germany ..... 3124795

[51] Int. Cl.[3] ..... D05B 65/02

[52] U.S. Cl. ..... 112/292; 112/297; 112/300

[58] Field of Search ..... 112/292, 298, 300, 301, 112/291, 296, 295, 297

[56] References Cited

U.S. PATENT DOCUMENTS

| | | | |
|---|---|---|---|
| 3,386,402 | 6/1968 | Ross | 112/300 X |
| 3,624,735 | 11/1971 | Hedegaard | 112/300 X |
| 3,709,176 | 1/1973 | Papajewski et al. | 112/292 |
| 3,776,161 | 12/1973 | Papajewski et al. | 112/292 |
| 4,077,342 | 3/1978 | Stechenrider | 112/292 |
| 4,365,568 | 12/1982 | Ross | 112/298 X |

FOREIGN PATENT DOCUMENTS

| | | | |
|---|---|---|---|
| 1924281 | 4/1971 | Fed. Rep. of Germany | 112/292 |
| 282193 | 9/1970 | U.S.S.R. | 112/292 |
| 711205 | 2/1980 | U.S.S.R. | 112/292 |

*Primary Examiner*—H. Hampton Hunter

*Attorney, Agent, or Firm*—John J. McGlew

[57] ABSTRACT

A thread cutter for a zig-zag sewing machine which has a needle which swings transversely to the material feed direction to form a zig-zag seam of predetermined width while the needle is reciprocated to pierce material to be sewn in cooperation with a revolving looper as the material being sewn is moved transverse to the swing direction and includes a cutting knife which cooperates with a movable catcher which is moved in time relationship to the rotation of the looper. The catcher is a plate-like member having an end terminating in the tip and a lateral edge on each side of the tip with one lateral edge having a first barb for engaging one leg of the needle thread loop and an opposite lateral edge having a second barb for engaging another leg of the needle thread loop, the one leading directly to the needle. The catcher is movable with the engaged thread portions into association with the knife to sever the threads so as to obtain a free length of thread ends independent of the piercing position of the needle. The second barb is advantageously staggered relative to the first barb by an amount which is less than the maximum width of the zig zag seam. The thread guide surface is provided next to the second barb which extends toward the catcher tip. The thread catcher may also have a third barb on the same side as the second barb which is provided for each half of the overstitch range for the leg of the thread which leads directly to the needle. The spacing between the barbs are equal to the maximum width of the zig-zag seam.

8 Claims, 5 Drawing Figures

THREAD CUTTER FOR A ZIG-ZAG SEWING MACHINE

FIELD AND BACKGROUND OF THE INVENTION

This invention relates in general to sewing machines and in particular to a new and useful thread cutter for a zig-zag sewing machine which includes a catcher member having barbs on respective side edges which engage portions of the legs of the needle loop and move it into association with a cutting knife.

A thread cutter is known from German Utility Model No. 1,968,920. For cutting off the thread, the sewing machine is stopped first at the end of a seam with the needle in a bottom position. In zig-zag sewing machines it is generally left to chance whether the needle is stopped in the left or right overstitch position of the needle. Then the sewing machine is started at low speed for a half revolution of the arm shaft until the needle is in a top position. The looper shaft with the looper performs a complete revolution. In the course of this one revolution, the looper tip engages the needle loop formed during the ascending movement of the needle in order to widen it and to conduct it completely around the bobbin case with the looper thread supply. After the looper tip has engaged the needle thread loop and widened it partly, the thread catcher, which has on one side a recess with a barb, is moved from its starting position against the force of a return spring beyond the path of motion of the needle. Its tip penetrates the needle thread loop, and the leg of the needle thread loop leading to the sewing material and the looper thread are guided by the thread catcher to the side with the recess, while the leg of the needle thread loop leading to the needle is deflected to the other side of the thread catcher.

In the further course of the movement of the looper and of the thread catcher, the needle thread loop is conducted completely by the looper around the bobbin case. The thread catcher penetrates so far into the needle thread loop until the leg of the needle thread loop leading to the sewing material together with the looper thread, has arrived in the recess behind the barb. The recess is so arranged in the thread catcher of this device that the thread sections to be cut off are positively separated by the catcher tip during the piercing of the needle in the overstitch position farthest away from the thread catcher, and is still positively caught by the end of the stroke of the thread catcher. The looper thread caught in the recess behind the barb, and the leg of the needle thread loop leading to the sewing material are fed to a stationary counterknife during the return movement of the thread catcher by the return spring relaxing after its driving means has been shut off, and are cut off.

Since the needle has in one overstitch position a greater distance from the stationary counterknife than in the other, and the stroke of the thread catcher remains unchanged, the threads are necessarily cut off, after the machine has been stopped, in one overstitch position in a different distance from the last puncture of the needle than after the stoppage in the other overstitch position. For the thread ends remaining on the sewing material, there are no adverse effects from the different length resulting from the stitch position. But the reliability of the first stitch formation of a new seam following the thread cutter depends on the length of the thread end leading to the needle. Heretofore it as not possible to meet the requirement for optimally short thread ends in both overstitch positions of the needle, because the size of the catcher movement and the arrangement of the stationary counterknife depend on the result of the thread cutoff in the overstitch position of the needle closer to the thread catcher, in which the length of the needle thread end, after the thread cutoff in this overstitch position, must suffice for the first stitch formation of the new seam in order to avoid time losses caused, e.g. in an unsuccessful approach because of a too short thread end by the stoppage of the machine and the rethreading, and other disadvantages, like perforation of the sewing material by the needle. The stationary counterknife therefore had to be arranged in a greater distance from the stitch hole than it was desirable to obtain optimally short thread ends on the sewing material.

When the thread was cut off after the stoppage of the machine in the overstitch position farther away from the thread catcher, it was necessary to put up with longer thread ends on the sewing material.

SUMMARY OF THE INVENTION

The invention provides a thread cutter for zig-zag sewing machines in which optimally short thread ends remain on the sewing machine when the thread is cut off after the stoppage of the sewing machine in any overstitch position and the length of the needle thread end arriving from the needle eye prevents stitch position dependent wrong stitches at the head of a new seam, that is, the length must in any case suffice for the formation of the first stitch of a new seam.

The invention makes it possible to cut off the looper thread caught by the first barb of the thread catcher and the leg of the needle thread loop leading to the sewing material directly under the needle plate next to the oblong stitch hole, but to guide first the leg of the needle thread loop leading to the needle in at least one of the overstitch positions of the needle thread loop behind the other barbs arranged on the side of the thread catcher opposite the first barb, and to obtain this way and additional length of the needle thread arriving from the needle eye in the piercing position of the needle closer to the thread catcher, so that the reliability of the approach in the first stitch formation of a new seam following the thread cutoff is increased, and short thread ends are obtained on the underside of the sewing material.

In order to manage with a minimum stroke of the thread catcher without jeopardizing the catching efficiency, the second barb is staggered relative to the first barb by an amount which is less than the maximum width of the zig-zag seam.

By providing that the thread guide surface is next to the second barb the thread sections to be cut off are positively held separate by the leg of the thread needle loop not to be cut off.

The length of the thread end arriving from the needle eye can be exactly determined in dependence on the stitch position by insuring that the thread catcher for each half of the overstitch range a separate barb for the leg of the needle thread loop leading to the needle, which are arranged separate from each other in the distance of the maximum width of the zig-zag seam.

A fine grading of the length of the free thread end over the width of the zig-zag seam results from the application of the measure that the thread catcher have a plurality of barbs for each half of the overstitch sample.

Accordingly, it is an object of the invention to provide a thread catcher which is movable in the direction of swinging movement of the sewing needle toward and away from engagement with a cutting knife which includes an end terminating in a tip with a lateral edge on each side having respective barbs for engaging respective leg portions of a needle thread loop so that when the catcher moves the loop portions to the knife a free end of thread ends independently of the piercing position of the needle is obtained.

A further object of the invention is to provide a thread needle cutter which is simple in design, rugged in construction and economical to manufacture.

DESCRIPTION OF THE PREFERRED EMBODIMENTS

Figure 1:
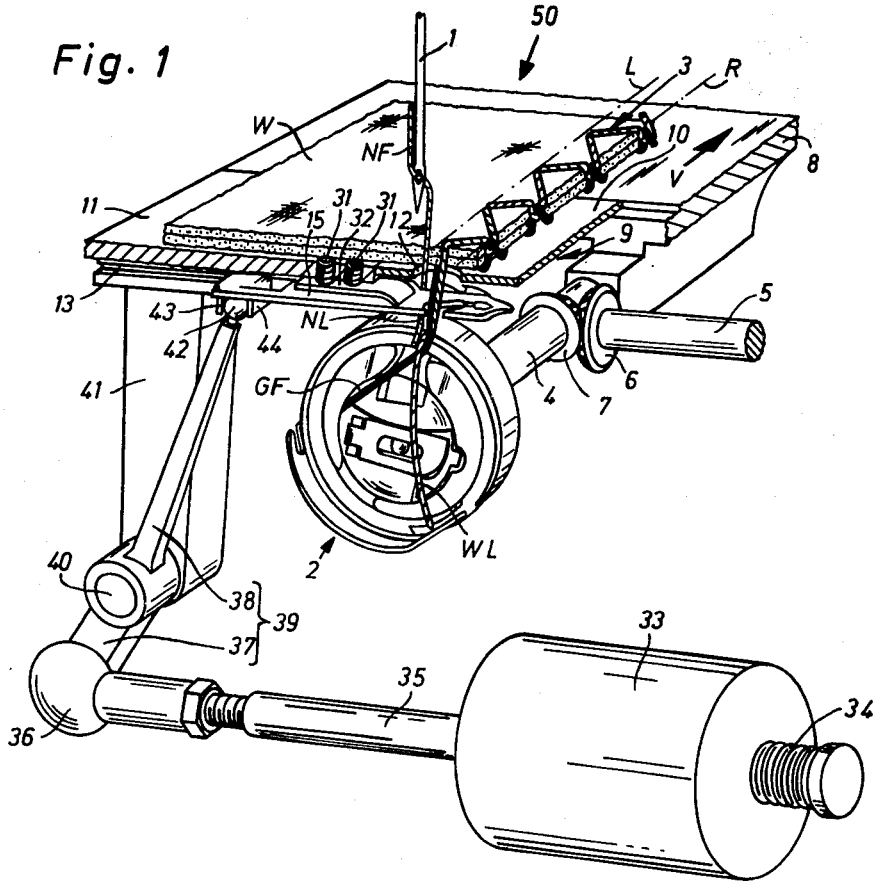
FIG. 1 is a perspective view partly in section and partly broken away of a zig-zag sewing machine having a thread cutter constructed in accordance with the invention.

A thread cutter for a zig zag sewing machine generally designated 50 which has a needle 1 which swings transversely to the material feed direction to form a zig-zag seam 3 of predetermined width having extreme end positions designated L and R includes means for feeding a workpiece W in a direction indicated by the arrow V transverse to the swinging of the needle. While the needle reciprocates to pierce the material to be sewn in cooperation with a revolving looper generally designated 2 which revolves in a plane perpendicular to the feed direction, a sewing thread forms a leg portion WL of a needle loop, a leg portion NL which is closer to the needle. The thread cutter includes a cutting knife which cooperates with a laterally shiftable thread catcher which moves in the same direction as the needle swing in directions toward or away from the cutting knife 32. A catcher 15 or 14 comprises a plane having an end terminating in a tip 16 and a lateral edge on each side 17 and 18 respectively. The first barb 21 is defined on the lateral edge 17 for engaging one leg WL of the needle loop thread and the opposite lateral edge has a second barb 26 for engaging another leg NL of the needle thread loop leading directly to the needle.

The thread carrying needle 1 of the zig-zag sewing machine is driven in known manner from the main shaft of the sewing machine (not shown). In addition to its ascending and descending movements, it also performs swinging movements of adjustable size transverse to the feeding direction, arrow V, FIG. 1 to form, in cooperation with looper 2, a double lock stitch zig-zag seam in sewing material or a workpiece W, consisting of needle thread NF and looper thread GF (stitch type 304 according to DIN 61 400). The width of the zig-zag seam is called the overstitch width. The overstitch or piercing position of needle 1 are designated with L=left and R=right. Looper 2 is arranged on a shaft 4 which is so driven from the main shaft of the machine over a shaft 5 and a pair of bevel gears 6,7 that looper 2 makes two revolutions per stitch formation.

The work supporting plate 8 of the sewing machine has a recess 9 in the range of the stitch forming point which is covered by needle plate 10 and a cover plate 11. In needle plate 10 is provided an oblong stitch hole 12 for the passage of needle 1. On the underside of cover plate 11 is provided a guideway 13 extending over the entire length of cover plate 11, transverse to the feeding direction, arrow V, in which a thread catcher 14 and 15 is guided for displacement.

Thread catchers 14 and 15 have a tip 16 whose two lateral edges 17 and 18 serve to separate the legs NL, WL of the needle thread loop. Lateral edge 17 of catcher tip 16, whose horizontal path of motion extends between the legs NL, WL of the needle thread loop forms together with a lateral boundary edge 19 of a recess 20 a barb 21 for pulling out the threads to be cut off. On its top side, each catcher 14, and 15 has a groove 22 extending from recess 20 to catcher tip 16 to receive the threads to be cut off, which terminates in an opening 23 which is V-shaped toward catcher tip 16. On the side of thread catcher 14 opposite recess 20 is provided a recess 24, whose one boundary edge 25 together with lateral edge 18 of thread catcher 14 forms a barb 26 for the leg NL of the needle thread loop leading to needle 1. The distance between barb 21 and 26 is less than the total width of zig-zag seam 3 to make sure that looper thread GF and the leg WL leading to sewing material W arrive in both overstitch positions L and R behind barb 21 and are caught in recess 20, while the leg NL of the needle thread loop leading to needle 1 is caught after the stoppage of the machine, only in the left overstitch position L and in the left half of the overstitch range of needle 1 behind barb 26 in recess 24.

In order to keep the leg NL of the needle thread loop leading to needle 1 separate from looper thread GF and from the leg WL of the needle thread loop leading to the sewing material, a thread guide surface 27 extending from recess 24 to catcher tip 16 is provided in thread catcher 14.

Recess 24, its boundary edge 25, barb 26, and thread guide surface 27 are also provided on thread catcher 15. In addition, thread catcher 15 has a recess 28 substantially in the distance of the width of zig-zag seam 3 from recess 24, whose lateral boundary edge 28 together with lateral edge 18 forms another barb 30. Recess 28 and barb 30 serve to catch the leg NL of the needle thread loop leading to needle 1 in the right half of the width of zig-zag seam 3, while leg NL in the left half of the width of zig-zag seam 3 is caught by recess 24 and barb 26. As it can be seen from FIG. 2–5, the distance between recesses 20 and 24 is greater than the distance between recesses 20 and 28. Because of these different distances, the needle thread loop caught in overstitch position L behind barb 26 in recess 24 is no longer than the needle thread loop caught in overstitch position R behind barb 30 in recess 28. The length of the free thread end determining the start of the following seam is thus independent of the piercing position of needle 1.

Cooperating with thread catcher 14,15 is a counterknife 32 secured by means of screws 31 on the underside of cover plate 11, whose end directed toward catcher tip 16 is bent down and bears with a light pressure on the top side of thread catcher 14,15. In order to vary the length of the free thread end arriving from needle 1, counterknife 32 can be displaced parallel to the direction of motion of thread catcher 14,15 and be secured.

For driving thread catcher 14,15 is provided an electromagnet 33 whose tension rod 35, which is under the action of a return spring 34, is connected over a knee-joint bar 36 with arm 37 of a two-arm lever 39 provided with arms 37 and 38. Lever 39 is mounted for free rotation on a journal 40, which is secured in a lug 41 provided on work supporting plate 8. At the free end of arm 38 is secured a ball pin 42 which protrudes into a guide formed by two lobes 43,44 of catcher 14,15 bent off downward. Thread catcher 14,15 is imparted by the above-described driving connection a horizontal displacement movement into a position in which barb 21 and, if thread catcher 15 is used barb 30 have moved beyond the right overstitch position of needle 1 indicated by line R, and barb 26 of thread catcher 14 moved beyond the left overstitch position indicated by line L of needle 1 and up to about the center of the width of zig-zag seam 3. In this position looper thread GF and the leg WL of the needle thread loop leading to the sewing material is positively caught by barb 21 in recess 20 in any overstitch position of zig-zag seam 3, after the machine has been stopped. The leg NL leading to needle 1 is only caught by barb 26 in recess 24 with the needle in the left half of the overstitch range of zig zag seam 3, after the stoppage of the machine, and with the needle in the right half of the overstitch range of zig-zag seam 3 leg NL is caught only by barb 30 in recess 28, after the stoppage of the machine.

Electromagnet 33 is so switched in known manner into the control current circuit of the sewing machine that the circuit of electromagnet 33 can be closed only in the bottom position of the needle, and the sewing machine still performs a half revoltuion of the arm shaft. The mode of operation of the thread cutter is as follows:

At the end of a zig-zag seam, the sewing machine driven by means of a known stop motor is stopped briefly in the bottom position of the needle, and it is left to chance in which overstitch position needle 1 happens to be at the moment. If the sewing machine is stopped in the right overstitch position R with the needle in a bottom position, and electromagnet 33 is energized and at the same time the motor circuit is closed for the duration of a half revolution of the arm shaft the needle 1 is brought during the cutting from its bottom position into its top position, and looper 2 performs a full revolution. The electromagnet 33 displaces thread catcher 14,15 after looper 2 has engaged with its tip the needle thread loop and begins to widen it by movement of the two-arm lever 39 from its starting position laterally of needle 1 beyond its path of motion, to the right, related to FIG. 1, into an end position shown in this figure. Catcher tip 16 penetrates into the thread needle loop, with its leg WL leading to the sewing material and looper thread GF bearing on lateral edge 17, while leg NL of the thread needle loop leading to needle 1 bears on lateral edge 18 of thread catcher tip 16. In the further course of the catcher and looper movement, the thread needle loop is conducted by looper 2 completely around the bobbin case with the looper thread supply, and thread catcher 14,15 penetrates so far into the thread needle loop until the thread leg WL leading to sewing material W and looper thread GF slide off lateral edge 17 and arrive behind barb 21 in recess 20 and, if thread catcher 15 is used, leg NL leading to needle 1 slides off lateral edge 18 and arrives behind barb 30 in recess 28.

If needle 1 pierces the cloth in the left overstitch position L, electromagnet 33 is energized, after the sewing machine has been stopped, with the needle in a bottom position, and at the same time the motor circuit is closed for the duration of a half revolution of the arm shaft, so that needle 1 is brought during the cutting time from its bottom position into its top position and looper 2 performs a full revolution. Then electromagnet 33, after looper 2 has engaged the thread needle loop with its tip and begins to widen it, displaces thread catcher 14,15 over two-arm lever 39 from its starting position laterally of needle 1 beyond its path of motion to the right, related to FIG. 1 into the end position shown in this figure. In addition to the above-described catching of the leg WL of the thread needle loop leading to the sewing material, and of the looper thread GF behind barb 21 in recess 20, the thread leg NL leading to needle 1 slides off lateral edge 18 in this overstitch position and arrives behind barb 26 in recess 24. Due to the thread guide surface 27, leg NL of the thread needle loop is held separate from leg WL and looper thread GF.

After needle thread NF has dropped off looper 2 guided over the bobbin case of looper 2, electromagnet 33 becomes currentless, so that spring 34, which is now relaxed, can move thread catcher 14 back into its starting position.

During the return movement, a length of thread corresponding to the size of this movement is pulled out from the looper and needle thread supply. Leg WL of the needle thread loop leading to sewing material W and looper thread GF come to lie in groove 22 of the thread catcher 14, and are cut off at the end of the return movement by the stationary counterknife 32 in cooperation with the V-shaped boundary edge of opening 23. Since the cutting edge of counterknife 32 is arranged directly next to stitch hole 12, and the horizontal path of movement of thread catcher 14 extends directly under the needle plate, optimally short thread ends and the length of leg NL of the needle thread loop caught after the stoppage of the machine in any overstitch position behind barb 21 suffice for the formation of a new seam. Due to the deflection of needle thread leg NL from recess 20 about recess 24 behind barb 26 on the opposite side of catcher thread 14,15 after the stoppage of the machine in the left overstitch position L of needle 1, a length of the free needle end leading to the needle eye is obtained in overstitch position L, compensating the small distance from the stationary counterknife 32, which ensures the formation of the initial stitch of a new seam.

In most cases it suffices to provide a single barb on the side of the thread catcher opposite barb 21, behind which thread leg NL of the needle thread loop leading to needle 1 is caught only in one overstitch position, in the represented embodiment in the left position.

Figure 2:
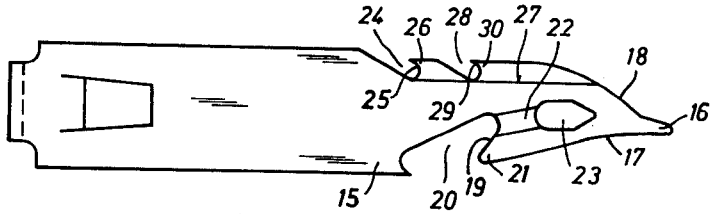
FIG. 2 is a top plan view of a first embodiment of the thread catcher.
Figure 3:
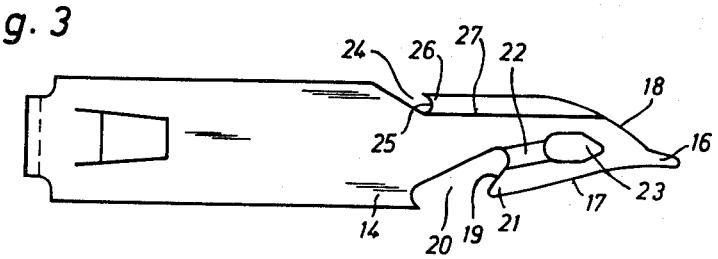
FIG. 3 is a view similar to FIG. 2 of another embodiment of the thread catcher.
Figure 4:
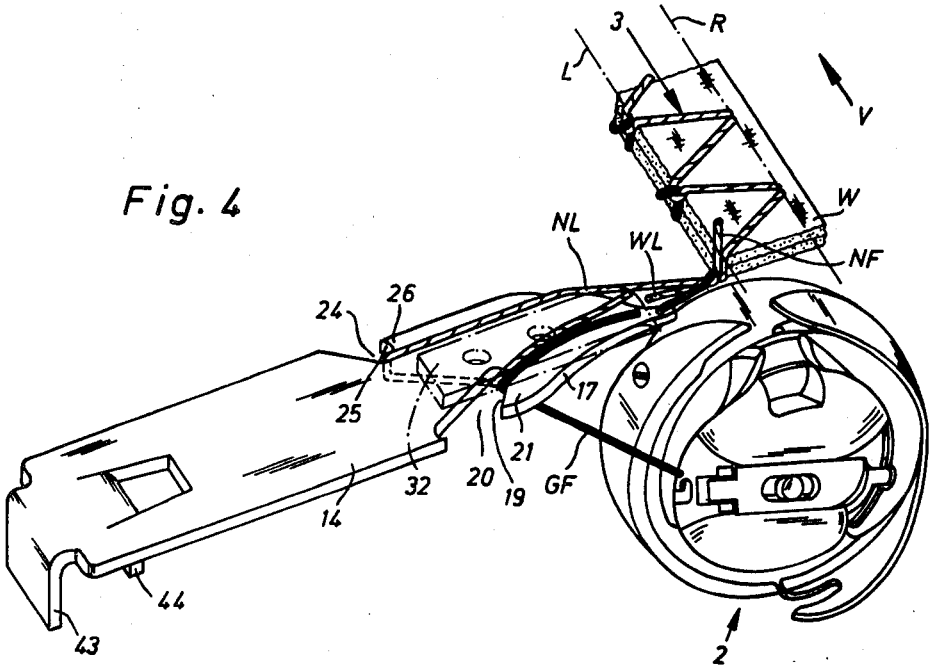
FIG. 4 is a perspective of a portion of the mechanism shown in FIG. 1 shown at the end of a cutting operation after the sewing machine has been stopped in the left overstitch position closer to the thread catcher.
Figure 5:
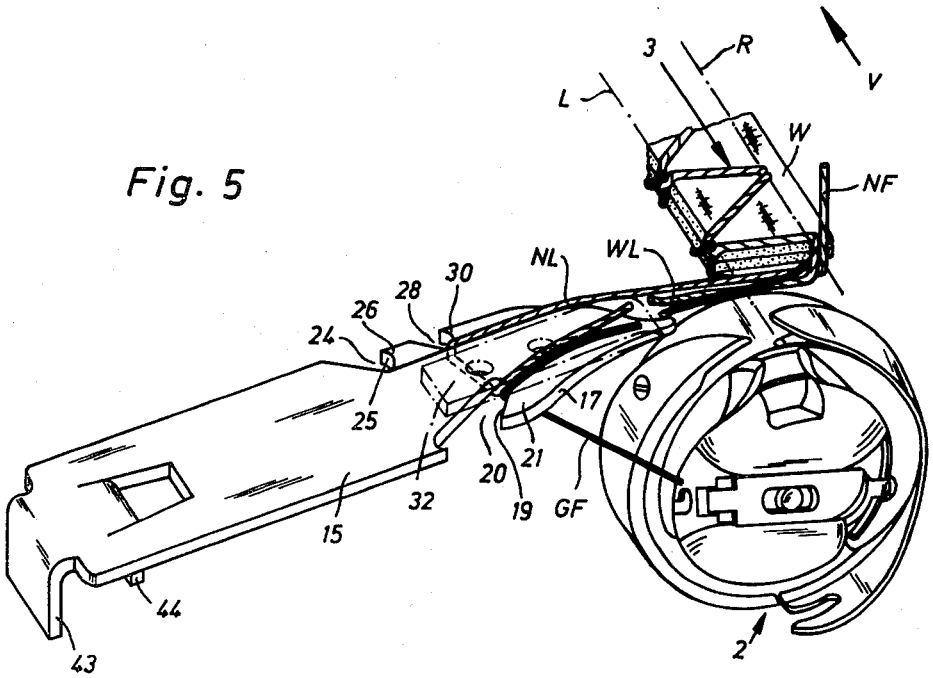
FIG. 5 is a view similar to FIG. 4 showing the embodiment of the catcher in accordance with FIG. 2 at the end of the cutting operation after the sewing machine has been stopped in the right overstitch position farther away from the thread catcher.

If this thread leg NL is to be caught after the stoppage of the machine in any overstitch position in order to obtain longer free thread ends for the following head start of the seam, several barbs are provided on the side of thread catcher 14,15 opposite barb 21. In the embodiment of FIG. 2, two barbs 26 and 30 are provided. With the size of the movement of thread catcher 15 unchanged, thread leg WL and looper thread GF are conducted in any case behind barb 21 into recess 20, while thread leg NL leading to needle 1 is conducted in the left half of zig-zag seam 3 behind barb 25 into recess 24, and in the right half of zig-zag seam 3 behind barb 30 into recess 28.

While specific embodiments of the invention have been shown and described in detail to illustrate the application of the principles of the invention, it will be understood that the invention may be embodied otherwise without departing from such principles.

What is claimed is:

1. A thread cutter for a zig-zag sewing machine having a needle which swings transversely to the material feed direction to form a zig-zag seam of predetermined width while the needle reciprocates to pierce the material to be sewn in cooperation with a revolving looper as the material is moved transversely to the swing direction and the looper revolves in a plane perpendicular to the feed direction, comprising a cutting knife disposed adjacent to said needle, and a thread catcher movable in directions of movement of the needle toward and away from engagement with said cutting knife, said catcher having one end terminating in a tip and a lateral edge on each side of said tip with one lateral edge having a first barb for engaging one leg of a needle thread loop and an opposite lateral edge having a second barb for engaging another leg of the needle thread loop leading directly to the needle, said catcher being movable to engage said knife to cut the thread so as to obtain a free length of thread ends independently of the position of the needle.

2. A thread cutter according to claim 1, wherein said second barb is staggered relative to said first barb along the length of said catcher by an amount which is less than the maximum width of the zig-zag seam.

3. A thread cutter according to claim 1, wherein said catcher includes a thread guide surface adjacent to said second barb which extends toward said tip.

4. A thread cutter according to claim 1, wherein said thread catcher has for each half of the overstitch range an additional barb adjacent said second barb for the leg NL of the needle thread loop leading to the needle which are arranged separately from each other with a spacing equivalent to the maximum width of said zig-zag seam.

5. A thread cutter according to claim 1, wherein said thread catcher has a plurality of additional barbs on said opposite lateral edge in spaced relationship in a number corresponding to each half of the overstitch range of the needle.

6. A thread cutter according to claim 1, including a double arm lever extending into the vicinity of said catcher, said catcher having a depending end portion engaged over the end of one of said arms, and electric motor means connected to the other of said arms to shift said arms to shift said catcher relative to said knife.

7. A thread cutter according to claim 1, including a thread guide surface defined on one surface of said catcher extending along said lateral edge toward said tip from said second barb including a third barb located on said second barb on said second opposite lateral edge.

8. A thread cutter according to claim 1, including a groove defined in said latch extending from said first barb toward said tip and including an opening in said catcher between said groove and tip.

* * * * *